US006986181B2

(12) United States Patent
Murphy et al.

(10) Patent No.: US 6,986,181 B2
(45) Date of Patent: Jan. 17, 2006

(54) PATIENT POSITIONING DEVICE

(75) Inventors: Stephen P. Murphy, Westfield, MA (US); Edward T. Murphy, Douglasville, GA (US); George W. Murphy, Franklin, MA (US)

(73) Assignee: GES Company, Douglasville, GA (US)

( * ) Notice: Subject to any disclaimer, the term of this patent is extended or adjusted under 35 U.S.C. 154(b) by 17 days.

(21) Appl. No.: 10/080,071

(22) Filed: Feb. 21, 2002

(65) Prior Publication Data

US 2003/0154550 A1 Aug. 21, 2003

(51) Int. Cl.
*A47C 20/02* (2006.01)

(52) U.S. Cl. ..... 5/648; 5/624
(58) Field of Classification Search ..... 5/648, 5/650, 624
See application file for complete search history.

(56) References Cited

U.S. PATENT DOCUMENTS

| | | | | |
|---|---|---|---|---|
| 2,623,518 A | | 12/1952 | Vaquette | 128/75 |
| 2,695,017 A | | 11/1954 | Hermeyer | 128/71 |
| 3,124,126 A | | 3/1964 | Spinks | 128/71 |
| 3,302,641 A | | 2/1967 | Berne et al. | 128/71 |
| 3,672,361 A | | 6/1972 | Forneron | 128/71 |
| 3,889,664 A | | 6/1975 | Heuser et al. | 128/75 |
| 3,986,499 A | | 10/1976 | Fischer | 128/71 |
| 4,002,165 A | | 1/1977 | Lind | 128/71 |
| 4,099,523 A | | 7/1978 | Lowrey | 128/75 |
| 4,362,151 A | | 12/1982 | Cottrell | 128/75 |
| 4,466,427 A | | 8/1984 | Granberg | 128/71 |
| 4,535,762 A | | 8/1985 | Natchev | 128/71 |
| 4,602,619 A | | 7/1986 | Wolf et al. | 128/75 |
| 4,664,101 A | | 5/1987 | Granberg | 128/84 R |
| 4,898,185 A | | 2/1990 | Fuller | 128/876 |
| 4,981,148 A | | 1/1991 | Fuller | 128/876 |
| 5,052,378 A | | 10/1991 | Chitwood | 128/71 |
| 5,297,539 A | | 3/1994 | Liebl et al. | 601/26 |
| 5,308,359 A | | 5/1994 | Lossing | 606/242 |
| 5,333,623 A | | 8/1994 | Fuller | 128/875 |
| 5,362,302 A | | 11/1994 | Jensen et al. | 601/24 |
| 5,416,939 A | * | 5/1995 | Maalouli | 5/610 |
| 5,444,882 A | | 8/1995 | Andrews et al. | 5/618 |
| 5,672,157 A | | 9/1997 | Gallagher et al. | 602/32 |

* cited by examiner

*Primary Examiner*—Michael Safavi
(74) *Attorney, Agent, or Firm*—Woodcock Washburn LLP

(57) ABSTRACT

The patient positioning device of this invention relates to an apparatus used to assist a patient into a supine position and additionally through which traction is applied to the spine, such as physical therapy and chiropractic treatment. The patient positioning device is preferably a stand alone portable device that can be readily transported and adapted to almost any horizontal surface, such as a treatment table. A primary application of the leg support of this invention is in raising and supporting a patient's lower legs during before, during, and after traction is applied to a patient. The device includes a lower support frame, vertical supports, and a leg support coupled to a top frame. The patient positioning device may also have a motor which powers the leg support to rotate from a lowered position, in which a patient's lower legs rest on the leg support, to an elevated position in which a patient's lower legs are elevated. Once in the elevated position, traction can be applied to the lower back preferably with a cable and a board that is placed across the front of a patient's thighs.

35 Claims, 6 Drawing Sheets

PATIENT POSITIONING DEVICE

FIELD OF THE INVENTION

The invention relates to an apparatus used to position a patient into the supine position. This invention also relates to a system that positions a patient and applies traction to the spine, such as physical therapy and chiropractic treatment.

BACKGROUND OF THE INVENTION

The practice of applying traction to the spine of a patient for therapeutic purposes is commonly prescribed by physicians, physical therapists and chiropractors. When professional judgment calls for a patient to be placed in a supine position, a harness is normally attached to the patient by encircling the lower abdomen with a harness that consists of a belt which must be attached by straps to a traction head. The Saunders Group, Incorporated of Chaska, Minn. sells harnesses of this type including its harness model # 46210. The belt portion which encircles the abdomen must be cinched tightly enough to capture the pelvis of the patient and thus transfer the traction force from the traction head through the belt to the pelvis and in turn to the lower spine. When applying traction, the upper part of the body is similarly captured by a thoracic harness. Thoracic harnesses including that designated as model no. 46205 can also be obtained from The Saunders Group, Incorporated of Chaska, Minn.

In order to place a patient in the supine position, the clinician first places the patient on a treatment table with the patient's back resting on the table and with the patient's legs extended straight and essentially level. The clinician then assists the patient in raising his/her legs onto a stool that is placed on the table between the patient's lower legs and the table such that the upper legs are close to vertical and the lower legs are parallel to the plane of the table. Stools are available from the Chattanooga Group, Inc. The clinician can then adjust the patient's lower legs' elevation by loosening and then retightening a vertical adjustment clamp while supporting the patient's legs so the stool does not collapse to its minimum height.

Difficulties arise with this treatment method in the case of obese, elderly or pregnant patients. With obese patients, for instance, the harness belt is frequently difficult to tighten sufficiently to capture the pelvis, which results in the force from the traction head being distributed through the soft tissues throughout the pelvis. This results in (1) discomfort to the patient; (2) slippage of the belts; and (3) uncertainty as to the actual spinal treatment force.

This invention relates to a patient positioning device for controlling the movement of a patient into the supine position. This invention also relates to a system for positioning a patient into the supine position and applying traction to the patient.

SUMMARY OF THE INVENTION

The patient positioning device of this invention can be readily transported and attached to a horizontal or inclined surface such as a patient treatment table. The patient positioning device can be attached by straps and clamps or the like to the table surface. The patient positioning device of this invention rotates from a lowered position to an elevated position. In the lowered position, a patient's lower legs, the portion below the knees, are rested on the patient positioning device. The patient positioning device is then rotated to the elevated position in which the patient's feet and lower legs are elevated. The patient positioning device has a motor and an actuator that can be used to move the device between the lowered and raised positions. The motor powers the actuator to move the positioning device. In a preferred embodiment, the motor has a remote controller that permits a patient or attendant to power the motor. Once in the elevated position, traction or other therapy can be applied to the patient.

The portable patient positioning device preferably includes a bottom support frame, a leg support, and vertical support members that couple the bottom support frame to the leg support. Attached to the bottom support frame may be a pivot and a stationary bar. The pivot bar and the stationary bar are, in a preferred embodiment, parallel.

The patient positioning device's actuator preferably includes a threaded cylinder coupled to the stationary bar o the bottom support and a screw disposed in the threaded cylinder and attached to a vertical support member. When the motor is powered, the motor rotates the screw in and out of the cylinder. When the screw rotates out of the cylinder, the screw pushes on the vertical support member to push the vertical support member in a rotary manner about the bottom frame pivot. As the vertical support member rotates the leg support, which is coupled to the vertical support, also rotates to the elevated position. Conversely, when the screw is rotated into the cylinder, the screw pulls the vertical support and the leg support in a rotary manner into the lowered position.

The leg support may be mounted to the device so that it can move laterally relative to the device. Preferably, the leg support moves laterally with a rail system and locks in place in a desired position that is best for a patient's anatomy. In a preferred embodiment the locking system includes a pin that fits into a hole. There are preferably a series of holes and the pin is placed in the hole that corresponds to the desired location, thereby locking the leg support in place. The pin may be spring loaded in order to hold the pin in the hole.

The patient positioning device may also have a pad, which is preferably a thigh support pad, that is coupled to the leg support. The thigh support pad can be moved laterally with the leg support so that it can be moved behind a patient's thighs. This pad provides comfort to a patient's legs as it provides a stationary force absorbing fulcrum for the moment arm if traction is to be employed. Preferably, the leg cushion is coupled to the pad, so that the leg cushion moves laterally with the rails and the pad. As described above and below, the tracks and rails permit the thigh support pad and the leg support to be moved to a position that fits a particular patient's anatomy.

This invention can also be used as a therapeutic or passive exercise device. In particular, the support can be rotated between the lowered and elevated positions. One such application where the device could be used as a passive exercise device is after a patient has had hip surgery.

This invention also includes a system for treating a patient's back by applying traction to the back. The system includes the patient positioning device including any of the embodiments described above and below and a device for applying the patient in traction. The traction device is preferably includes a femur board, a cable, and a traction unit. The femur rests on the front of the patient's thighs, and the cable extends from the femur board to the traction unit. Once the patient's lower legs are elevated with the positioning device, the femur board is placed across the thighs, and the traction unit pulls on the cable and the femur board, placing the patient in traction. Except where so expressly limited in the claims, the patient positioning device can be used with a variety of traction devices, including harness type devices such as those described above.

This invention also includes methods of positioning a patient's legs with the patient positioning device, and methods of treating a patient with the patient positioning device and the device for applying traction.

Other features of the invention are described below.

DETAILED DESCRIPTION OF PREFERRED EMBODIMENTS

Figure 1:
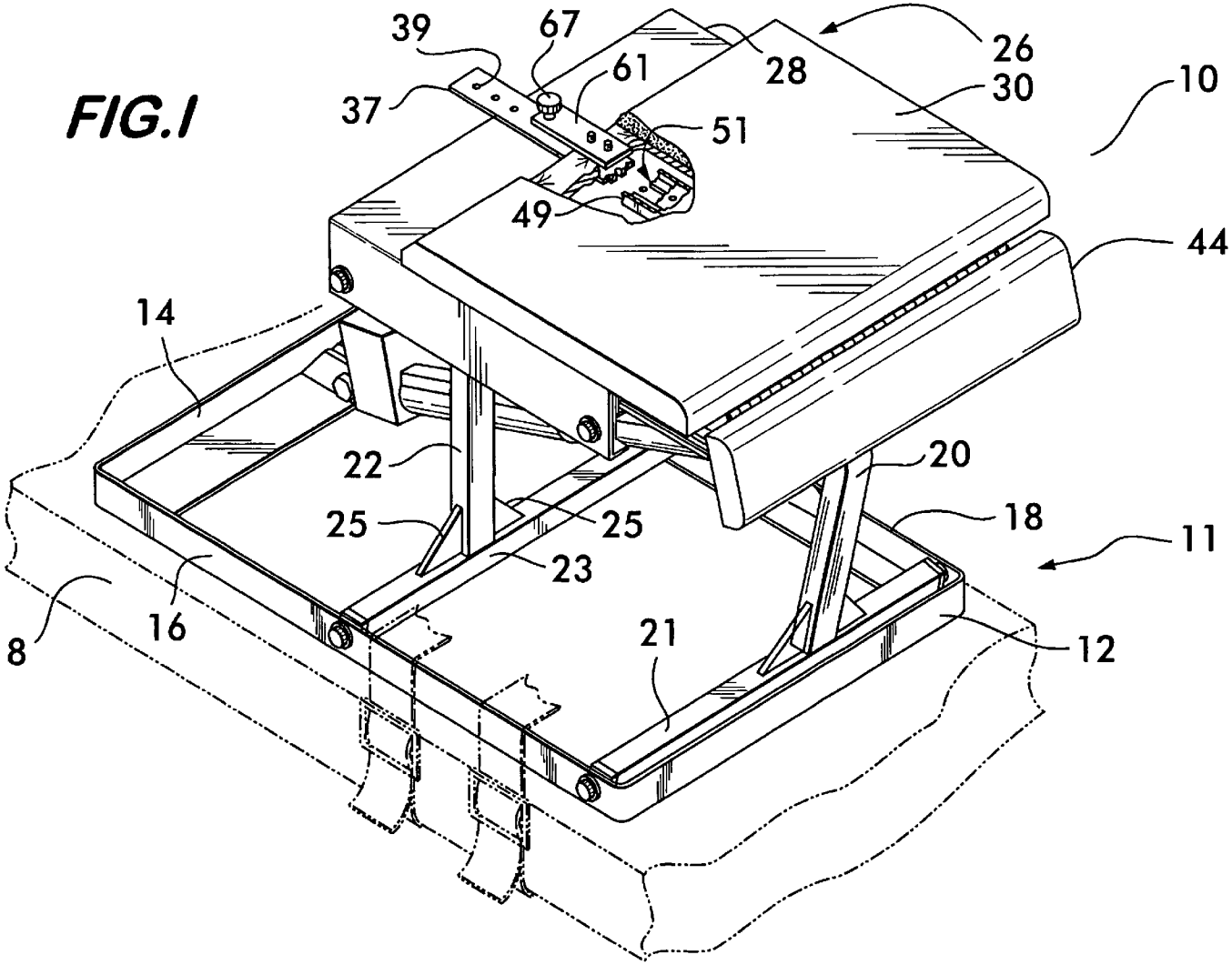
FIG. 1 is a perspective view of a patient positioning device according to a preferred embodiment of this invention.
Figure 2:
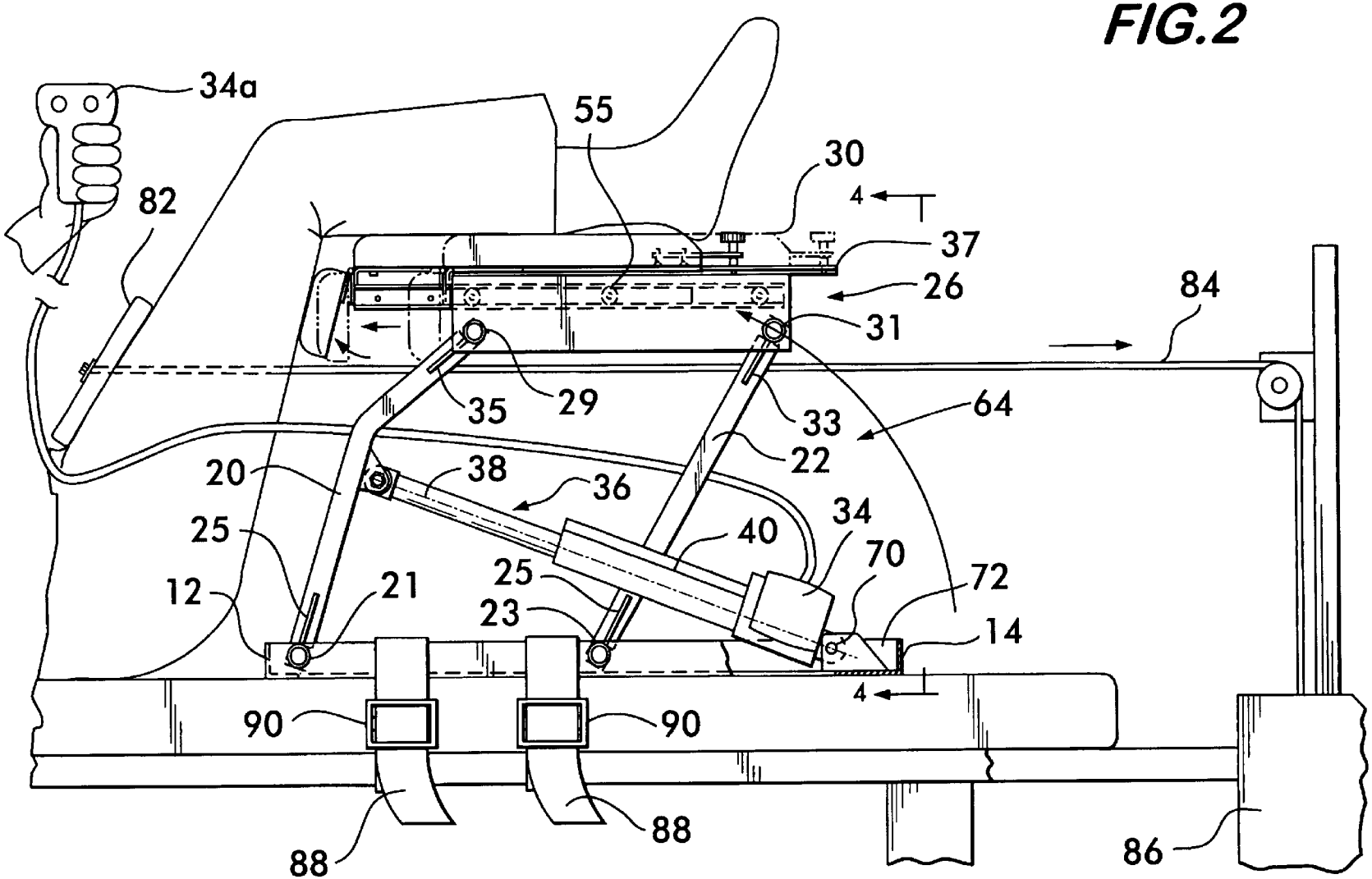
FIG. 2 is a side view of the preferred embodiment of FIG. 1 disposed on a treatment table and in an elevated position.
Figure 3:
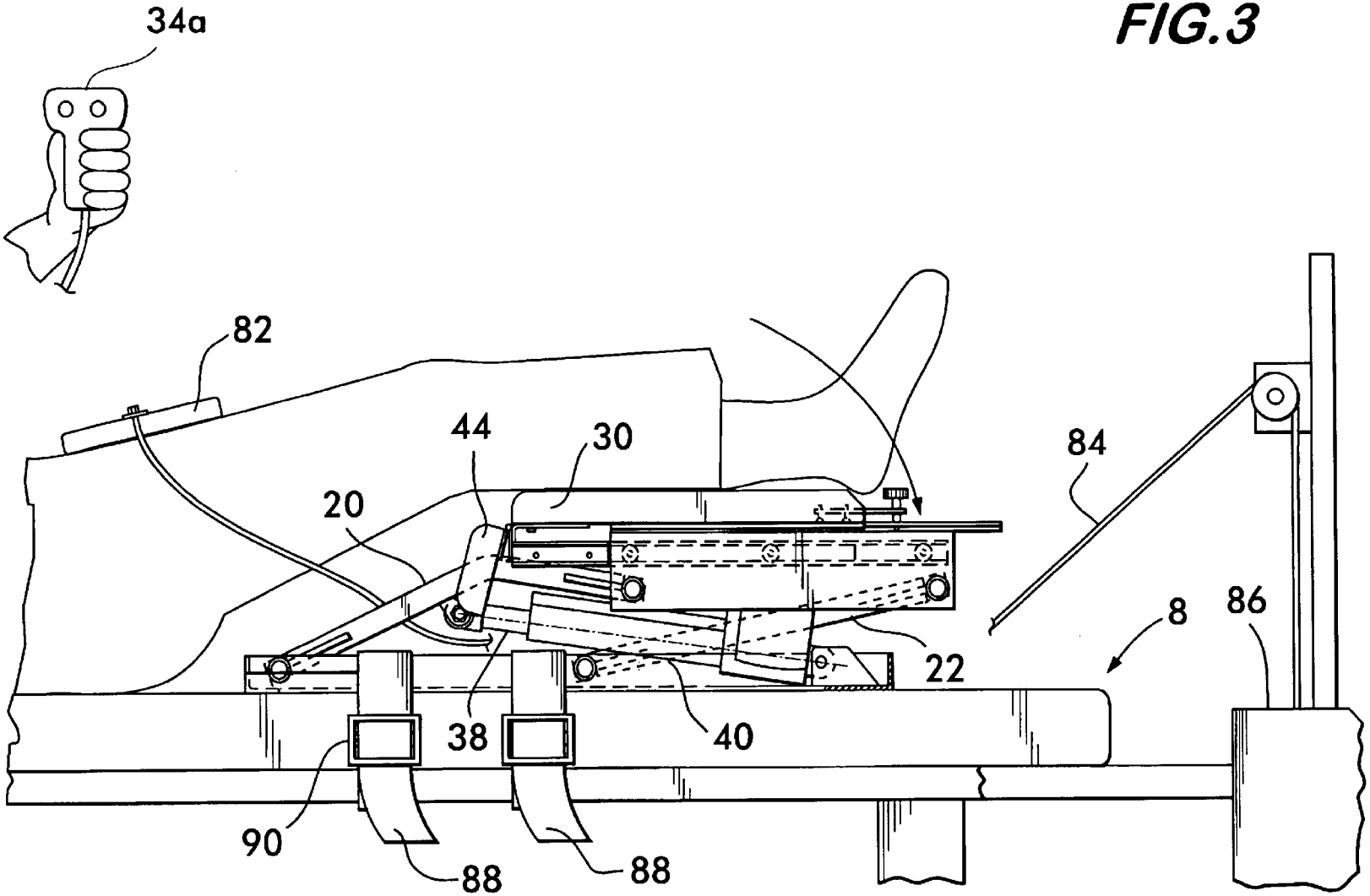
FIG. 3 is a side view of the preferred embodiment of FIG. 1 disposed on a treatment table and in a lowered position.
Figure 4:
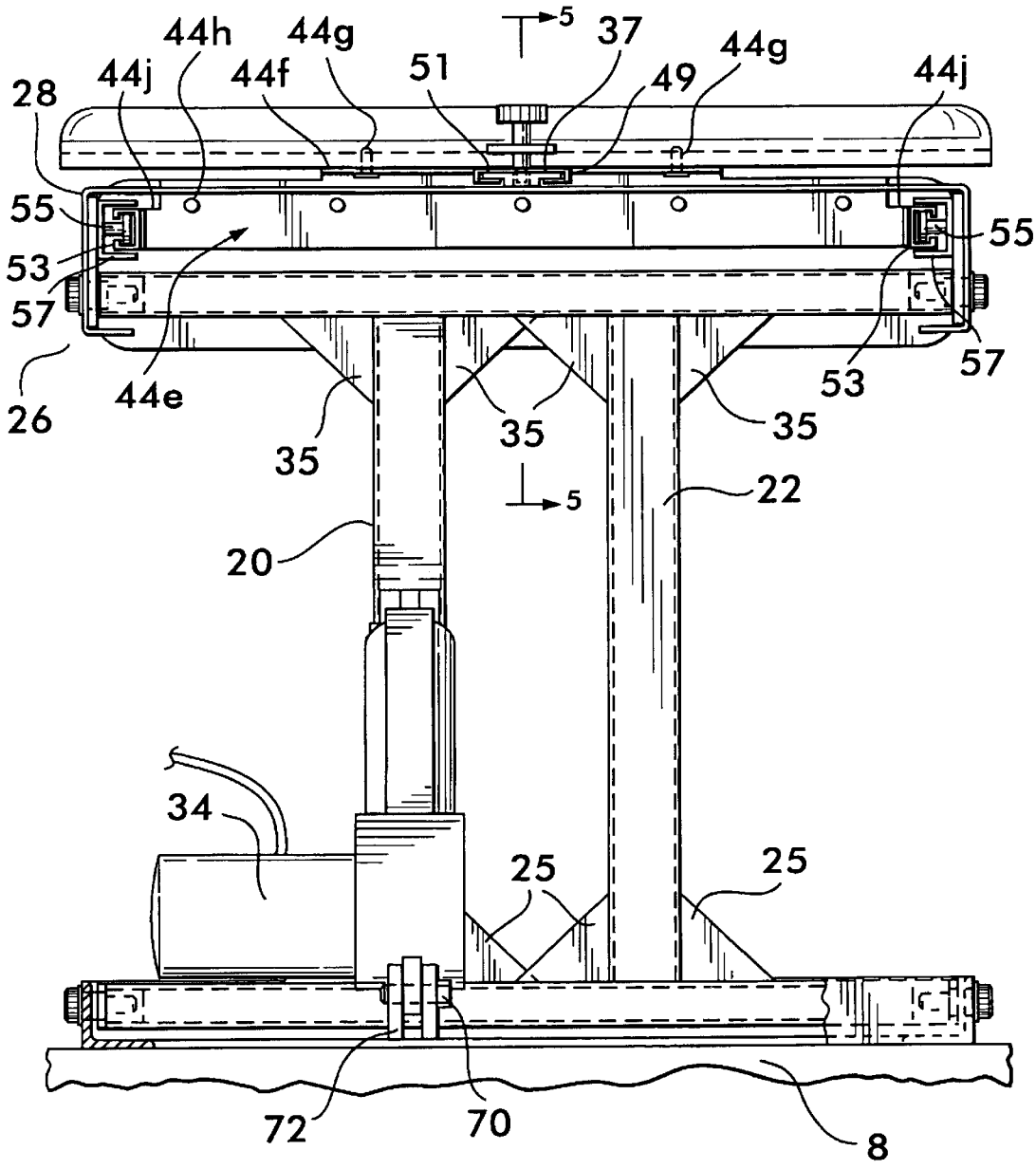
FIG. 4 is a view along line 4—4 of FIG. 2.

The patient positioning device 10 is portable and can be easily transported and adapted to a patient's treatment table 8 or any other suitable surface. The treatment table may, but need not be, a Triton Table available from the Chattanooga Group, Inc. The surface may be inclined. As described below, the patient positioning device 10 can be rotated from a lowered position to an elevated position. A perspective of an embodiment of the patient positioning device 10, that is partially cut away at the top, is shown in FIG. 1. FIGS. 2 and 4 illustrate the patient positioning device 10 in an elevated position, and FIG. 3 depicts the patient positioning device 10 in a lowered position. (FIG. 2 depicts the device 10 in an elevated position, but not fully elevated, and FIG. 4 depicts the device 10 in a fully elevated position so that the details of the device are better understood.)

As shown in FIG. 1, the patient positioning device 10 includes a bottom frame 11. The bottom frame 11 can have any number of configurations, and in the preferred embodiment shown, it is generally rectangular. Additionally, the bottom frame 11 can be constructed from any suitable material, but it is preferably metal. In the preferred embodiment shown, the bottom frame 11 has four bars 12, 14, 16, 18. The bars 12, 14, 16, 18 may be attached by any suitable means including but not limited to mechanical fasteners and welding.

Attached to the bottom frame 10 are a pair of vertical support members 20, 22. The vertical supports 20, 22 are depicted in FIGS. 1–3. Any number of vertical support members 20, 22 can be used, and they are preferably metal, but any suitable material can be employed. Vertical support member 20, as shown in FIGS. 2 and 3, may have an angular shape in order to accommodate the raising and lowering of the device 10 so as not to interfere with the upper portion of the device in the lowered position.

In the preferred embodiment show, the vertical support member 20 is coupled to a cross-bar 21 that extends between bottom support members 16 and 18, and the vertical support member 22 is coupled to a cross-bar 23 which also extends between bottom support members 16 and 18. The cross-bars 21, 23, which are shown in FIG. 1, are rotatably mounted to the bottom support members 16 and 18 with a bearing or the any suitable means. The vertical support members 20, 22 are attached to the cross-bars with welds and support plates 25, which are shown in FIG. 4. Other attachment means such as mechanical fasteners may be used. The preferred embodiment is exemplary, and other vertical supports may be used. For instance, a pair of vertical supports attached to each of the sides may be employed. As described in more detail below, because the cross-bars 21, 23 are rotatably mounted, the vertical support members 20, 22 can rotate with the cross-bars to move the device 10 from the lowered position of FIG. 3 to the elevated position of FIG. 3.

The vertical support members 20, 22 are preferably attached to the cross-bars 21, 23 such that they are off-set from the center line, as shown in FIG. 4. This provides a stable support for the device. Any number of support members can be used, and they can be attached to the bottom and top frames by any suitable means in any locations. The embodiment shown is the preferred embodiment.

Figure 5:
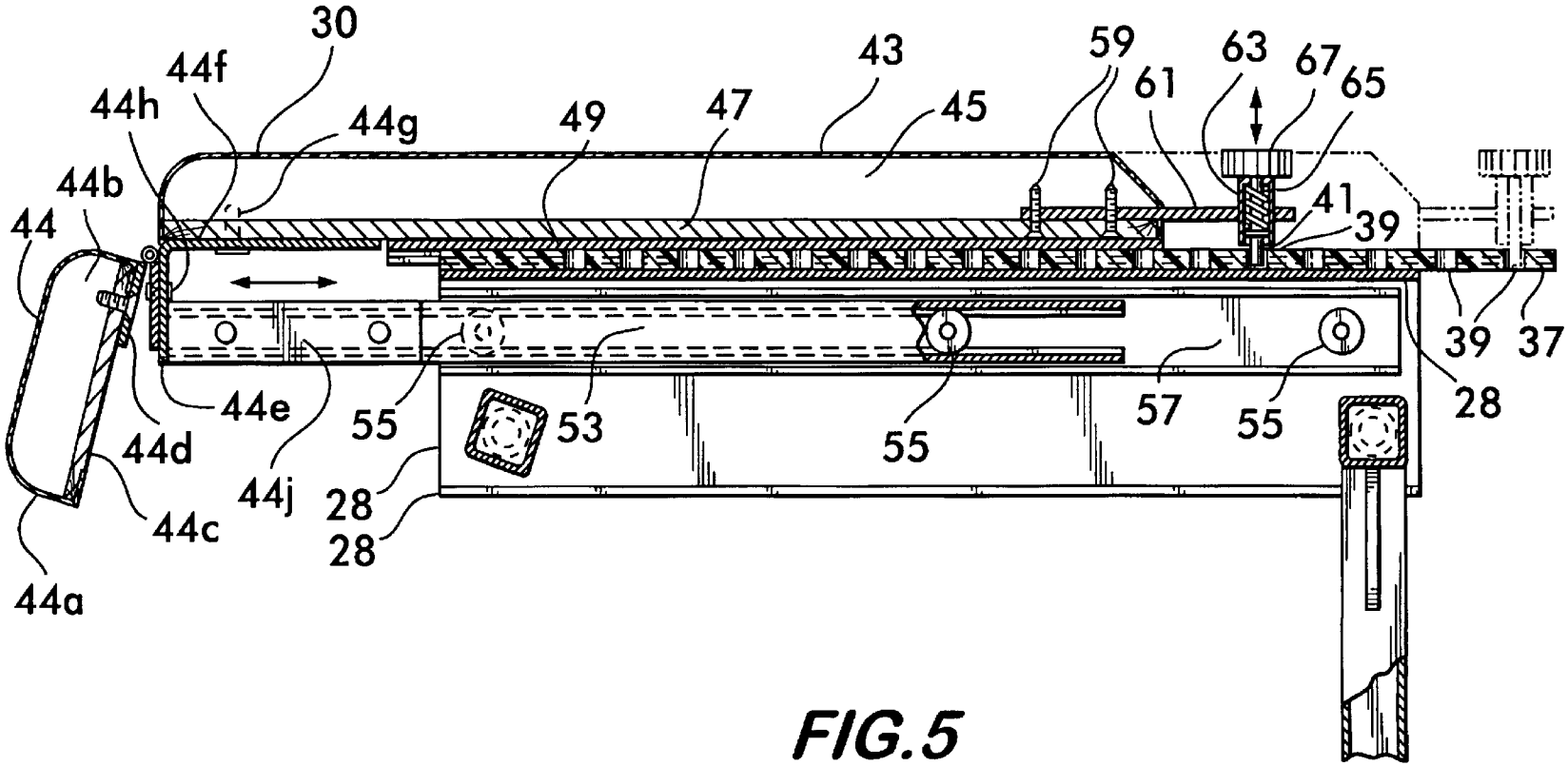
FIG. 5 is a cross-section taken along line 5—5 of FIG. 4.

The patient positioning device 10 also includes a top frame 26, which is also shown in FIGS. 1–5. In the preferred embodiment shown, the top frame 26 is stationary and includes a substantially c-shaped support member 28, which is shown in FIGS. 1, 4 and 5. Extending between the sides of the support members are two cross-bars 29, 31. The cross-bars 29, 31 are rotatably mounted to the side support members by any suitable means including for example bearings. Each of the cross-bars 29, 31 is attached to one of the vertical support members by welding. Optionally, support plates 33, 35, which are best shown in FIG. 4, can be used to support the vertical members. Other means such as mechanical couplings and fasteners can be used.

The stationary top frame 26 also includes a stationary guide 37, which is best shown in the cross-section of FIG. 5 and the perspective cut away of FIG. 1. The leg support 30 of FIG. 1 has been cut away to expose the guide 37, which has also been cut so that the cross-section of the guide 37 can be exposed. The stationary guide or track is substantially T-shaped as shown in the end view of FIG. 4 and the perspective of FIG. 1. Disposed within the stationary guide 37 are a series of holes 39. Each of these holes 39 is for receiving the pin 41 as shown in FIG. 5 and as described in more detail below. The guide 37 is mounted on the support member 28 by mechanical fasteners (not shown) or any suitable means.

The device 10 further includes a leg support 30 that is in a preferred embodiment a pad or cushion. The leg support 30 is preferably any suitable cushioning material. Preferably, vinyl 43 covering a foam cushion 45 or the like is used. The leg pad 30 may have a relatively rigid back 47 such as wood or metal. The leg support 30 is mounted on a c-shaped rail 49, which has a channel 51, as shown best in FIG. 4, that surrounds the stationary T-shaped guide 37 so that the rail 49 and the attached leg support 30 can slide over the T-shaped guide 37 and move laterally relative to the base and top frames as shown in FIG. 2 with the phantom lines and the solid lines. The support 30 can be attached to the rail 49 by any suitable means. Together the leg support 30—including the cover 47, the cushion 45, and the backing 47, and the c-shaped rail 49—form a moveable piece that moves on the guide track 37. The c-shaped rail 49 is also shown in FIG. 1 where the leg support 30 has been cut away. The rail 49 has also been cut away to show the guide 37 and the channel 51 defined by the rail 49.

Other means may be used to mount the leg support 30 so that it can move laterally relative to the top frame 26. For example, a torsion spring and a rod (not shown) or other rail and track systems may be used.

The leg support 30 may have a locking system for locking the leg support 30 in place after it has been moved laterally relative to the bottom and top frames. The locking system may include the pin 41, the guide track 37, and bracket 61. Bracket 61 is mounted to the leg support 30 by screws 59 or fasteners as best shown in FIG. 5. The screws 59 thread into the bracket 61, the leg support 30, and the leg support backing. The pin 41 is mounted in a pin housing 65, which is mounted to the bracket 61 with any suitable means so that the housing 65 can move up and down relative the bracket 61.

The pin 41 can be spring loaded downward as viewed in FIG. 5 by spring 63. Spring 63 is mounted within pin housing 65. Knob 67 is coupled to the pin housing 65. The pin 41 is spring loaded so that it fits within one of the guide holes 39, as shown in FIG. 5. The knob 67 can be pulled upward to pull the pin housing 65, which lifts the pin 41 upward against the pressure of the spring 63 and out of the hole 39. The pin 41 is what retains the leg support 30 and prevents the leg support 30 from moving once it has been positioned; thus, it defines a preferred embodiment of a locking system.

As best understood with reference to FIGS. 2 and 5, the leg support 30 can be positioned laterally relative to the top or bottom frames by lifting the pin 41 against the pressure of the spring 63, sliding the leg support 30 laterally relative to the bottom and top frames as shown by comparing the phantom lines and the solid lines in FIG. 2.

Figure 4A:
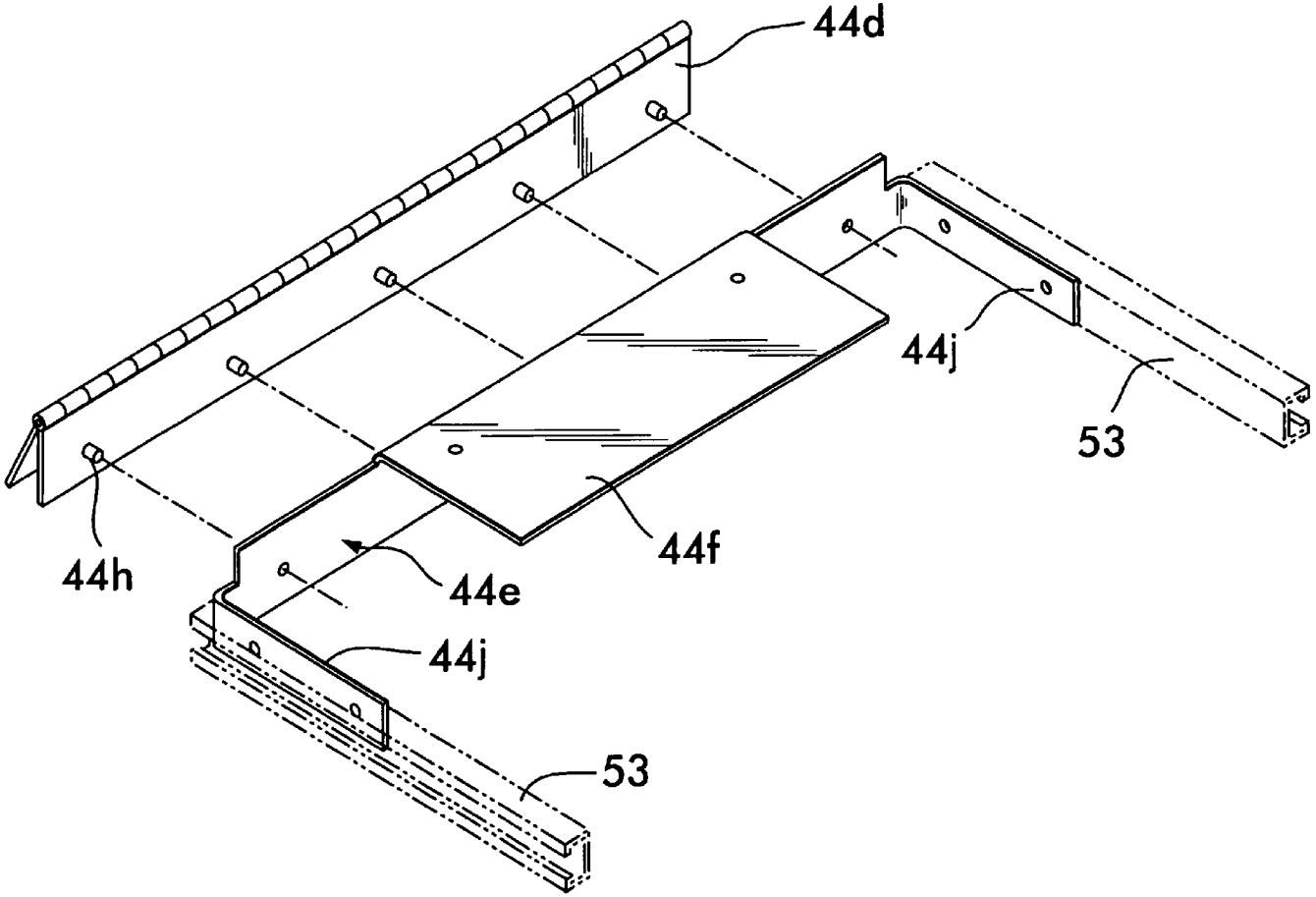
FIG. 4A is an assembly drawing of a preferred embodiment of the thigh pad of FIG. 1's connection to the patient positioning device of FIG. 1.

The patient positioning device 10 also includes a pad 44 that cushions the upper leg just above a patient's knees, as best understood with reference to FIGS. 2 and 5. Like the leg pad 30, the pad 44 can be any suitable cushioning material, preferably vinyl 44*a* covering foam 44*b* with a stable backing 44*c* such as wood, reinforced plastic, or metal. The pad 44 is preferably coupled by a hinge bracket 44*d* to the top frame support member 28, as best shown in FIG. 4A. Preferably, the hinge 44*d* is relatively rigid such that it can hold the pad 44 in place. In another embodiment not shown, the pad 44 may be rigidly connected to the top frame.

The pad 44 is preferably mounted so that the pad 44 can move laterally relative to the top and base frames. The hinge bracket 44*d* is connected to bracket 44*e* with fasteners 44*h* as shown in FIG. 4A. The top 44*f* of the bracket 44*e* is connected to the leg support 30 with fasteners 44*g* or the like as shown in FIGS. 4 and 5. Because the pad 44 is mounted to the leg support 30 the pad 44 moves with the leg support 30.

In order to support the leg support 44 and the pad 30, the device 10 may further include a pair of c-shaped rails 53 which are attached to the side portions 44*j* of bracket 44*e* with fasteners or any suitable means as best shown in FIG. 4A. The c-shaped rails 53 ride on a series of wheels 55, three in the preferred embodiment, as best understood with reference to FIGS. 4 and 5. The wheels 55 are preferably mounted to the top frame member 28 with brackets 57, which are preferably c-shaped.

When the leg support 30 and the pad 44 move laterally, the rails 53 ride over the wheels 55. The lateral moveable pieces of the device 10 include the leg support 30, the pad 44, the hinge 44*d*, the bracket 44*e*, the rails 53, and the rail 49. The stationary pieces include the guide 37, the wheels 55, the brackets 57, and the top support member 28. The leg support 30 rail 49 moves over the guide 37, and the rails 53 move over the wheels 55 in order to move the leg support 30 and the pad 44 laterally.

The patient positioning device 10 also includes a motor 34 for moving the patient positioning device 10 between a lowered and an elevated position. The motor 34 may be any suitable motor and is selected based on the patient positioning device's intended use. If the patient positioning device 10 is intended to be used for lifting a patient's lower legs in preparation for applying therapeutic traction, then a motor having a relatively low duty cycle rating can be selected. In contrast, if the patient positioning device is intended to be used repetitively as a passive exercise device, then a motor with a high duty cycle rating should be employed.

The motor 34 powers an actuator 36 to move the patient positioning device 10 between the elevated and lowered positions of FIGS. 2 and 3. In the preferred embodiment shown, the actuator 36 includes a screw 38 disposed in a cylinder 40, as best shown in FIG. 3. The screw may be a ball screw. The screw 38 is connected to one of the vertical support members 20, and the cylinder 40 is hinged to the bottom frame 11 by fasteners 70 and brackets 72 or any other suitable means. Thus, when the motor 34 powers the screw 38, the screw 38 moves relative to the cylinder 40. As the screw 38 moves, it drives the patient positioning device including the vertical support 20, the top frame 26, and the leg support pad 30 to rotate about the cross bars 21, 23. Additionally, the top cross bars 29, 31 rotate relative to the top frame 26 to change the angle of the vertical supports 20, 22 relative to the top frame. Further operation of the motor 34 and the system is provided below.

The motor 34 may have a remote control 34*a* so it can be powered by the patient, therapist, or other care provider. In the case of passive exercise, the remote controller provides patient control over movement to the supine position, which permits the patient to control the level of pain. Other actuators may be used, such as a linear motor, rotary actuator, hydraulic piston, or any suitable means for rotating the patient positioning device 10.

Although the preferred embodiment preferably uses a motor, a manual device such as a screw and hand-crank could be employed in place of the motor and actuator. Furthermore, hydraulic or pneumatic pistons can be used as well.

The patient positioning device can be used alone to support a patient's legs or with a traction device. Although any suitable traction device can be used, in a preferred embodiment a traction device 80 which includes a femur board 82, a cable 84, and a traction unit 86, which are shown in FIG. 2. The femur board 82 extends across the front of a patient's thighs, and the cable 84 extends from the femur board 82 to the traction unit 86. Although not shown, straps, belts and the like may be used to couple the femur board to the table 8. For example, a belt could extend from either lateral side of the femur board and extend down beneath the table and attach together to hold the femur board in position. The belt prevents the femur board from sliding out of a preferred position.

The cable 84 can be attached to the femur board 82 by any suitable means. The patient positioning device 10 preferably has an opening 64 through which the tension cable 84 can be threaded. In the preferred embodiment, this opening 64 is defined by the space between the bottom 11 and top frames 26. The cable 84 threads between them.

The traction unit 86 applies tension to the cable 84 to pull the femur board 82 and apply traction to the patient. Other traction devices such as harnesses can be used with the patient positioning device. The traction device could be any of a number of suitable devices, but is preferably a traction unit made by Chattanooga Group, Inc. Even more preferably, the traction unit is a Triton traction unit and could be the MP-1 Digital Traction Unit.

Except where expressly stated in the claims, the traction device could be any number of devices. For example, any number of harness systems including those referenced above can be used. The femur board system is, however, preferred.

Operation of the patient positioning device can best be understood with reference to FIGS. 2 and 3. The portable patient positioning device 11 can be placed on a patient's treatment table or other flat area including an inclined surface. If desired the patient positioning device 10, can be coupled to the treatment table 8 by one or more straps 88 and buckles 90 or other mechanism as shown in FIG. 3. When placed on the surface, the patient positioning device 10 is in the lowered position of FIG. 3. The patient places his feet and lower legs on the leg pad 30, as shown in FIG. 3.

Preferably, the support pad 30 and the pad 44 are first positioned laterally, so that the support 30 is positioned to fit a patient's anatomy and the pad 44 is in close proximity with the patient's upper legs just above the patient's knees, and locked in placed in the extended position. The angle of the extension pad 44 can be adjusted by adjusting the hinge 44*d*. Alternatively, these lateral and hinge adjustments can be done after the patient positioning device 10 is moved to the elevated position.

In order to adjust the lateral position of the leg support 30 and the pad 44, the knob 67 of the locking system is pulled to pull the pin 41 against spring pressure and out of the hole. The support pad 30 is then slid laterally by pulling or pushing the pad 30 so that the c-shaped rail 49 moves over the t-shaped guide 37 and the rails 53 move over the wheels 55. Once the leg support 30 is in the desired position that fits a patient's anatomy, the knob 67 and pin 41 are released, and the pressure of the spring 63 moves the pin 41 into the corresponding hole 39 in the guide 37. The pin 41 then retains the leg support 30 in position until the pin 41 is moved to move the leg support 30.

The patient positioning device 10 is moved to the elevated position, by operating the motor controller 34*a*. This can be done by the patient, which is advantageous in controlling any patient discomfort and permitting the patient to find the best semi-fowler position that fits the patient's anatomy. When powered, the motor 34 powers the actuator 36. In the preferred embodiment shown, the screw 38 is rotated relative to the cylinder 46 and moves away from the cylinder 46 in a typical ball screw/lead screw arrangement. As the screw 38 extends further out from the cylinder 46, the vertical support members 20, 22 are pushed upward to rotate, and the cross bars 21, 23, 29, 31 rotate relative to the respective bottom and top frames. Thus, the top frame, the leg support 30, and the vertical supports 20, 22 are rotating about the cross-bars 21 and 23, which defines pivots, to move the leg support 30 to the elevated position of FIG. 3. Additionally, the rotatably mounted cross-bars 21, 23, 29, 31 rotate relative to the bottom and top frames to adjust the angle at which the vertical supports extend from the bottom and top frames. The motor 34 is powered until the patient positioning device 10 is moved into the desired elevation position, which is in most instances the elevated position, as shown in FIG. 3. If desired, the support 30 and the pad 44 can be adjusted laterally once the patient positioning device 10 is in the elevated position of FIG. 2 as described above. All of this movement can be controlled by the patient or clinician with the controller 34*a*.

If desired, traction can then be applied with any traction apparatus, including but not limited to the femur board 82, as shown in FIG. 2. This can be done by powering the traction unit 86 to place a tension on the cable 84. The cable 84 pulls on the femur board 82 to provide the traction. The reverse steps can be performed to move the patient positioning device from the elevated position to the lowered position.

One benefit, but not the only benefit, of the patient positioning device of this invention is that it is a portable support. It can be readily transported, and used on almost any horizontal surface. Thus, it is particularly suited for use hospitals, patient care facilities, or home care situations. Another benefit of an embodiment of this invention is that the patient positioning device rotates between the lowered and elevated positions, as opposed to translating vertically. The rotational movement of the leg support is beneficial because without the device 10 vertical movement requires a secondary lateral adjustment of the patient or the support for the lower legs after elevation is achieved, and such adjustment can aggravate some back injuries or cause pain. Rotational movement is preferred because it imitates the normal articulation of the leg around the hip joint. These benefits of the device are not intended to limit the claims except where so stated in the claims.

The patient positioning device can also be used as a passive, therapeutic exercise device. By cycling the patient positioning device between the lowered and elevated positions, the patient positioning device can apply a therapeutic force to the lower body. Although this cycling has many applications, one such application is as a passive exercise device for a patient recovering from a hip-joint replacement. Movement of the hip soon after surgery is important but painful. The patient positioning device of this invention makes movement of the joints more comfortable and permits the patient to control the movement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A patient positioning device for positioning a patient in a supine position so that traction can be administered to the patient's back, comprising:

a bottom support frame comprising a pivot;

a leg support, that is coupled to the bottom support, and upon which the patient's lower legs rest in an attitude substantially parallel to the patient's spine throughout the full range of motion of the device;

a vertical support member coupled to the leg support;

a motor coupled to the bottom support frame; and an actuator, coupled to the vertical support member, which the motor powers to push the vertical support member and rotate the leg support and the patient's lower legs from a lowered position to an elevated position, such that the patient is moved to a supine position that includes the patient's lower legs being elevated and substantially parallel to the patient's spine and the patient's upper legs being disposed in an angular relationship with the patient's lower legs and back.

2. The patient positioning device of claim 1, wherein the actuator comprises a cylinder attached coupled to the bottom frame and a screw, which is coupled to the vertical support member, that extends into the cylinder.

3. The patient positioning device of claim 1, further comprising a pad that fits behind a person's thighs.

4. The patient positioning device of claim 1, further comprising a rail and a track for extending the leg support relative to the bottom support frame.

5. The patient positioning device of claim 1, further comprising a controller that is electrically coupled to the motor to control the movement of the device between the lowered and elevated positions.

6. The patient positioning device of claim 5, further comprising a pad that fits behind a person's thighs.

7. The patient positioning device of claim 6, further comprising a rail and track for moving the leg support and the pad relative to the bottom frame.

8. A patient positioning device that can be placed on a surface on which a person lies, and that can move a person's feet and lower legs between a lowered position and an elevated position, comprising:

a bottom frame comprising a pivot;

a leg support that is coupled to the pivot and upon which the person's lower legs rest in an attitude substantially parallel to the patient's spine; and a means for rotating the leg support and the person's lower legs about the pivot from the lowered position to the elevated position, in which the person is in a supine position that includes the patient's lower legs being elevated and substantially parallel to the patient's spine and the patient's upper legs being disposed in an angular relationship with the patient's lower legs and back.

9. The patient positioning device of claim 8, wherein the means for rotating comprises a motor.

10. The patient positioning device of claim 9, wherein the means comprises a controller for control the power to the motor and thereby move the device between the lowered and elevated positions.

11. The patient positioning device of claim 10, wherein the means for rotating further comprises an actuator.

12. The patient positioning device of claim 11, wherein the actuator comprises a screw and a cylinder.

13. The patient positioning device of claim 12, further comprising a vertical support coupled to the bottom frame and the leg cushion to which the screw is coupled, and wherein the cylinder is coupled to the bottom frame, so that when the screw moves linearly with respect to the cylinder the device rotates.

14. The patient positioning device of claim 8, further comprising a linkage that couples the bottom frame to the leg support.

15. An apparatus for supporting a patient's lower legs while undergoing spinal traction while in a supine position, comprising:

a base;

a leg support upon which the patient's lower legs rest;

a linkage that connects the base to the leg support and that rotates the leg support and the patient's lower legs from a lowered position to an elevated position in an attitude substantially parallel to the patient's spine, in which the patient is in a supine position that includes the patient's lower legs being elevated and substantially parallel to the patient's spine and the patient's upper legs being disposed in an angular relationship with the patient's lower legs and back.

16. The apparatus of claim 15, further comprising a motor that is coupled to the base to power the linkage and the leg support to rotate.

17. The apparatus of claim 16, further comprising a cylinder coupled to the base and the motor and a screw coupled to the linkage, the screw moving relative to the cylinder such that when the motor powers the screw, the screw moves to rotate the leg support from the lowered position to the elevated position.

18. The apparatus of claim 16, further comprising a controller that is electrically coupled to the motor to control the motor and the movement of the leg support.

19. The apparatus of claim 15, further comprising a pad coupled to the leg support for padding a patient's thighs.

20. The apparatus of claim 15, wherein the leg support is adjustable relative to the base so that the leg support can be extended relative to the base.

21. The apparatus of claim 20, further comprising a rail and a track for moving the leg support relative to the base.

22. A patient positioning device that rotates to lift a patient's lower legs while a patient is in a supine position, comprising:

a bottom support frame comprising a pivot;

a leg support;

a linkage that couples the leg support to the bottom support frame; and a motor that rotates the leg support about the pivot from a lowered position to an elevated position, in which the patient is in a supine position that includes the patient's lower legs being elevated and substantially parallel to the patient's spine and the patient's upper legs being disposed in an angular relationship with the patient's lower legs and back.

23. The patient positioning device of claim 22, further comprising a cylinder coupled to the bottom support frame and a screw coupled to the linkage, such that when the motor powers the screw, the screw moves relative to the cylinder to rotate the leg support from the lowered position to the elevated position.

24. The patient positioning device of claim 23, further comprising a pad that fits behind a person's thighs.

25. The patient positioning device of claim 23, further comprising a rail and a track for extending the leg support relative to the bottom support frame.

26. The patient positioning device of claim 22, further comprising a controller electrically coupled to the motor for controlling the movement of the leg support from the elevated and lowered position.

27. The patient positioning device of claim 25, wherein the pad is mounted to the leg support so that the pad moves with the leg support on the rail and the track.

28. A portable foot lifting device for supporting a patient's lower legs while undergoing spinal traction while in a supine position that can be set on a treatment table, comprising:

a bottom support comprising a pivot;

a lower leg support;

a linkage that couples the bottom support to the lower leg support; and an actuator, coupled to the linkage, which pushes the linkage and the lower leg support to rotate from a lowered position to an elevated position, in which the patient is in a supine position that includes the patient's lower legs being elevated in an attitude substantially parallel to the patient's spine and the patient's upper legs being disposed in an angular relationship with the patient's lower legs and back.

29. The patient positioning device of claim 28, wherein the actuator comprises a cylinder attached to the linkage and a screw, which is attached to the bottom support, the screw extending into the cylinder.

30. The patient positioning device of claim 28, further comprising a pad that fits behind a person's thighs.

31. The patient positioning device of claim 30, further comprising a rail and a track for extending the pad relative to the bottom support.

32. The patient positioning device of claim 31, wherein the leg support is coupled to the track and the rail so that the leg support moves with the pad relative to the bottom support.

33. The patient positioning device of claim 28, further comprising a motor that powers the actuator.

34. The patient positioning device of claim 33, further comprising a controller that is electrically coupled to the motor to permit a patient to control movement of the device.

35. A method for passively moving a patient's legs to the supine position, comprising:

resting a patient's lower legs on a cushion;

powering a motor which powers an actuator to rotate the leg cushion and the legs about the hip from a lowered position to an elevated position, in which the patient is in a supine position that includes the patient's lower legs being elevated in an attitude substantially parallel to the patient's spine and the patient's upper legs being disposed in an angular relationship with the patient's lower legs and back and powering the motor to cycle the cushion between the lowered position and the elevated position.

* * * * *